US007975851B2

(12) United States Patent
Kossowan et al.

(10) Patent No.: US 7,975,851 B2
(45) Date of Patent: Jul. 12, 2011

(54) SOIL REMEDIATION APPARATUS

(76) Inventors: Russell Gary Kossowan, Cochrane (CA); Lance Christopher Hayman, Thorsby (CA)

( * ) Notice: Subject to any disclaimer, the term of this patent is extended or adjusted under 35 U.S.C. 154(b) by 399 days.

(21) Appl. No.: 11/707,732

(22) Filed: Feb. 16, 2007

(65) Prior Publication Data

US 2008/0187400 A1 Aug. 7, 2008

(30) Foreign Application Priority Data

Feb. 7, 2007 (CA) ..... 2577510

(51) Int. Cl.
*F24B 15/00* (2006.01)

(52) U.S. Cl. ..... 209/370; 209/300; 209/283

(58) Field of Classification Search ..... 209/370, 209/373, 379, 300, 283
See application file for complete search history.

(56) References Cited

U.S. PATENT DOCUMENTS

| | | | | |
|---|---|---|---|---|
| 2,043,265 | A | 6/1936 | Roeder | |
| 4,882,021 | A * | 11/1989 | Barnhart | 204/157.15 |
| 4,927,528 | A * | 5/1990 | Doppstadt | 209/31 |
| 5,188,041 | A * | 2/1993 | Noland et al. | 110/246 |
| 5,199,354 | A * | 4/1993 | Wood | 110/241 |
| 5,228,804 | A | 7/1993 | Balch | |
| 5,294,065 | A * | 3/1994 | Harms et al. | 241/101.76 |
| 5,342,428 | A * | 8/1994 | Cook et al. | 75/401 |
| 5,563,066 | A | 10/1996 | Buchanan | |
| 5,819,950 | A * | 10/1998 | McCloskey | 209/241 |
| 5,942,022 | A | 8/1999 | Bislev et al. | |
| 6,534,306 | B1 | 3/2003 | Allen | |
| 6,543,963 | B2 | 4/2003 | Bruso | |
| 2004/0134395 | A1 * | 7/2004 | Eberhardt et al. | 110/341 |
| 2004/0134517 | A1 * | 7/2004 | Clark | 134/10 |
| 2004/0240942 | A1 | 12/2004 | Richter | |
| 2005/0166812 | A1 * | 8/2005 | Noll et al. | 110/346 |
| 2006/0024135 | A1 * | 2/2006 | Reinhardt et al. | 405/128.85 |

FOREIGN PATENT DOCUMENTS

| | | |
|---|---|---|
| CA | 2173704 | 4/1997 |

* cited by examiner

*Primary Examiner* — Stefanos Karmis
*Assistant Examiner* — Ernesto Suarez
(74) *Attorney, Agent, or Firm* — Klarquist Sparkman, LLP

(57) ABSTRACT

A soil remediation apparatus comprises: a trommel screen having an inlet and an outlet; a trommel screen housing, and air extraction means operable to extract contaminant vapors volatilized by the trommel screen during soil aeration from the housing and to contaminant remediation means, such as a biofilter. The trommel screen housing comprises: a trough in which the trommel screen is mounted with its inlet inclined upwards; a front cover mounted at the front of the trough and having an impacted soil inlet in communication with the trommel screen inlet; a rear cover mounted at the rear of the trough and having a vapor discharge outlet above the trommel screen and a treated soil outlet in communication with the trommel screen outlet, and a vapor cover frame at least partially removably mounted to the trough and a flexible vapor cover removably mounted over the frame.

23 Claims, 10 Drawing Sheets

SOIL REMEDIATION APPARATUS

CROSS-REFERENCE TO RELATED APPLICATION

The present application claims priority to Canadian application no. 2,577,510, entitled "Soil Remediation Apparatus," filed Feb. 7, 2007, by Russell Gary Kossowan and Lance Christopher Hayman. The Canadian application is incorporated herein by reference.

FIELD

The present disclosure relates generally to remediation and treatment of contaminated soil or material that contain organic compounds such as but not limited to hydrocarbons, and particularly to an apparatus for performing such remediation and treatment using a trommel screen.

BACKGROUND

Impacted soils occurring from industrial applications and upstream and downstream oilfield activities are becoming an increasing concern. Due to a growing population, public pressure, and environmental awareness, oil companies and industrial firms are exploring quality and cost effective approaches for cleaning up contaminated sites having such impacted soils.

Bioremediation of contaminated soils is a popular and affordable approach for treatment of most soil types and for most contaminates. For example, bio-remediation has been employed to treat hydrocarbon-impacted oilfield well sites. Bioremediation has become increasingly popular as technological advancements have made bioremediation cost-effective, and older treatment methods such as land-filling have fallen out of favor.

While Bio-piles, land farms and introduction of bacterium have been popular approaches to bio-remediation, these passive operations are typically slow-acting and can take years to remediate a contaminated site. These operations also disadvantageously require a large amount of space as soil must be excavated, piled offsite, then have a passive or active aeration system installed thereon.

Other known methods for bioremediation include using an active mixing action that passes soil through air. Such bioremediation methods include use of an Allu™/twister bucket or windrow turners (large rototillers) to contact the contaminated soil. One disadvantage of using Allu™/twister buckets or rototillers is that when the soil is treated, the contaminant vapors are liberated and escape into the air. Rototillers have the further disadvantage of only being able to treat a relatively thin layer of soil at the surface of a contaminated site. Also, both approaches require relatively dry and unfrozen conditions in order to be effective.

Another known method for treating contaminated soils is thermal desorption which actively heats the soil to a temperature which incinerates contaminated particles within the soil. Disadvantageously, this treatment tends to destroy the chemical components and structure of the soil, essentially turning the soil into ash thereby making the soil an unsuitable environment for organic growth.

Recently public pressure and legislation such as the Alberta Energy Board's Directive 58 has created a need to provide an efficient and cost-effective solution for remediating and treating contaminated soil in such a way that does not cause contaminants in the soil to be released into the air.

SUMMARY

According to one aspect, there is provided a soil remediation apparatus comprising: a trommel screen having an inlet and an outlet; a trommel screen housing, and air extraction means operable to extract contaminant vapors volatilized by the trommel screen during soil aeration from the housing and to contaminant remediation means, such as a biofilter. The trommel screen housing comprises: a trough in which the trommel screen is mounted with its inlet inclined upwards; a front cover mounted at the front of the trough and having an impacted soil inlet in communication with the trommel screen inlet; a rear cover mounted at the rear of the trough and having a vapor discharge outlet above the trommel screen and a treated soil outlet in communication with the trommel screen outlet, and a vapor cover frame at least partially removably mounted to the trough and a flexible vapor cover removably mounted over the frame.

The soil remediation apparatus can further comprise a coarse soil conveyor pivotally coupled to the housing near the rear cover plate, and pivotable between a deployed position and a retracted position. When the conveyor is in the retracted position, at least part of the conveyor will be located above the vapor cover frame, and the frame comprises a removable section that when removed enables the frame to receive at least part of the retracted conveyor.

The soil remediation apparatus can also further comprise trommel cleaning brushes, in which case the frame is configured to provide sufficient clearance for the housing to house the cleaning brushes therein.

The rear cover can further comprise a curtain covering at least a portion of the treated soil outlet. Such curtain assists in reducing the amount of volatilized vapors from escaping into the atmosphere.

The soil remediation apparatus can further comprise at least one heated air feed nozzle directed to feed heated air into the trommel screen to help with the volatilization process. Alternatively or additionally, at least one hot water heating tube can be mounted inside the trommel screen and fluidly coupled to a hot water supply also to provide heat to assist in the volatilization process.

According to another aspect, there is provided a kit for modifying a trommel machine into a soil remediation apparatus. The kit comprises (a) a front cover having an impacted soil inlet and mountable to the front of a trommel screen trough of the trommel machine such that the impacted soil inlet is in communication with an inlet of a trommel screen of the trommel machine; (b) a rear cover having a treated soil outlet and a vapor discharge outlet above the treated soil outlet and mountable to the rear of the trough such that the treated soil outlet is in communication with an outlet of the trommel screen and the vapor discharge outlet is above the trommel screen; (c) a vapor cover frame at least partially removably mountable to the trough; (d) a flexible vapor cover removably mountable over the frame; and (e) air extraction means for fluidly coupling to the vapor discharge outlet and operable to extract contaminant vapors volatilized by the trommel screen during soil aeration from the trommel machine and to contaminant remediation means.

DETAILED DESCRIPTION OF EMBODIMENTS

Figure 1:
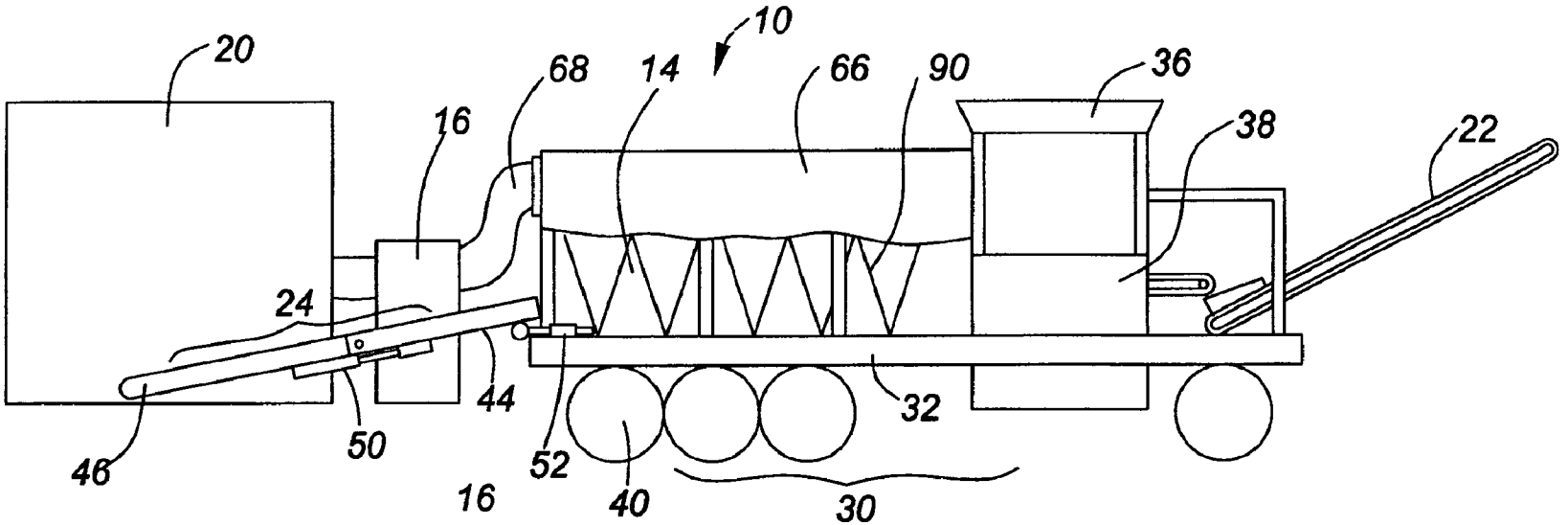
FIGS. 1 and 2 are side elevation and top plan views of a soil remediation apparatus using a trommel screen according to one embodiment.
Figure 2:
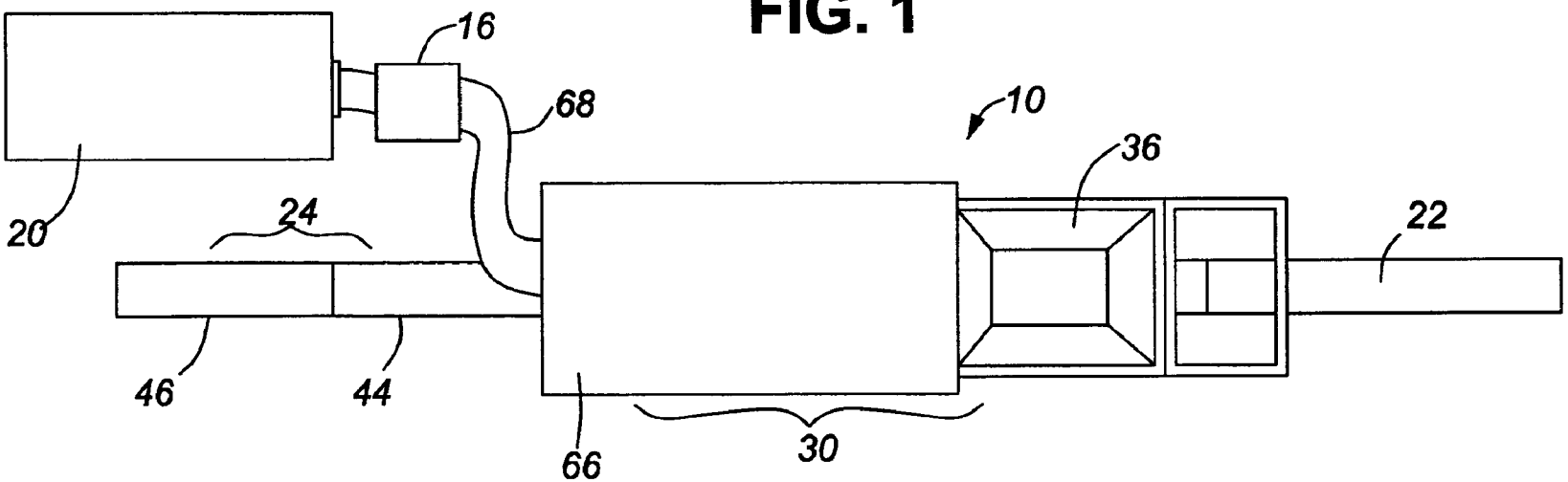
Figure 3:
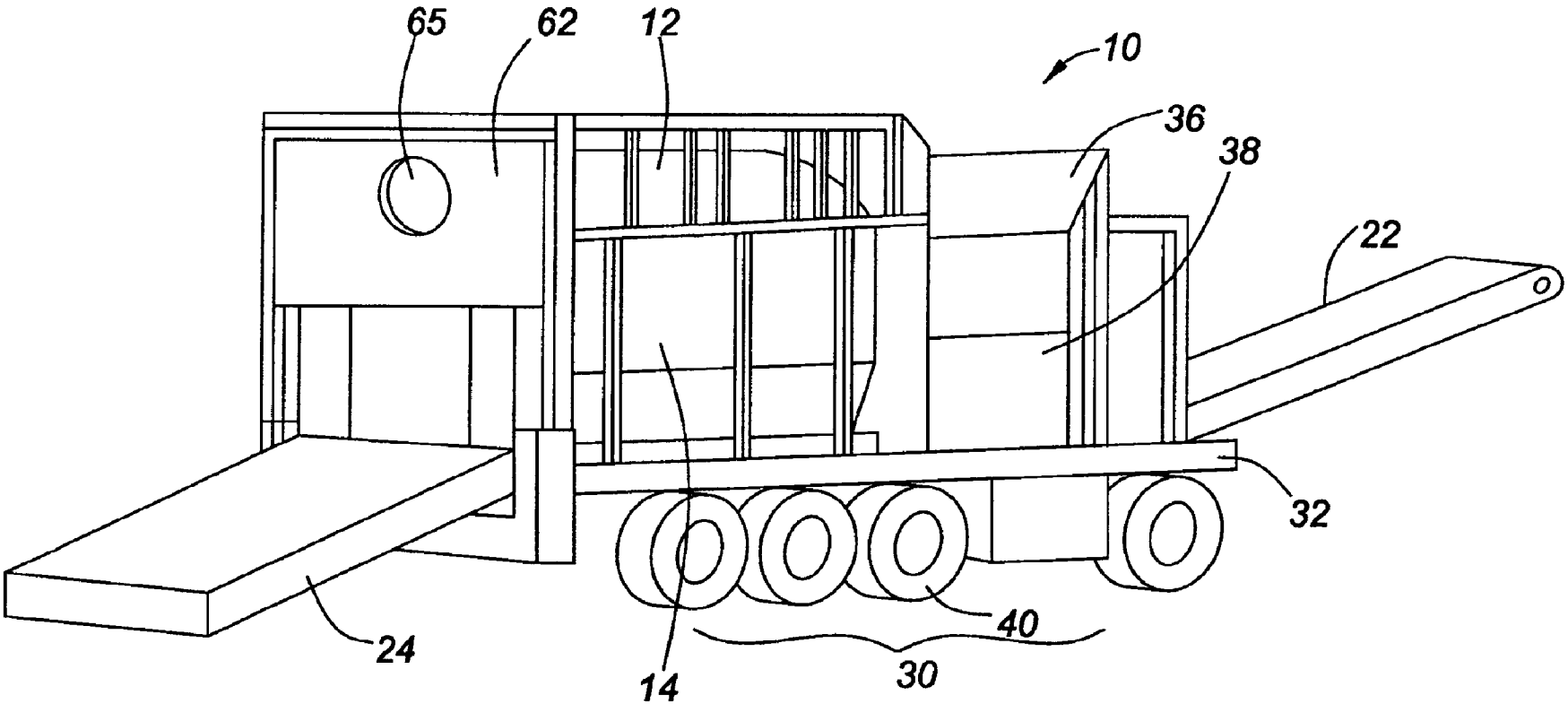
FIG. 3 is a perspective view of the soil remediation apparatus with a vapor capture cover removed, thereby exposing a view of part of a trommel screen of the apparatus.

According to one embodiment and referring to FIGS. 1 and 2, an apparatus 10 for remediating contaminated soil and other material is provided. Referring to FIG. 3, the apparatus 10 uses a rotating trommel screen 12 to aerate the soil and volatilize the contaminants therein. Hydrocarbon contaminants in the soil exist in an unstable bond with the soil, and the rotating trammel screen 12 creaks down clods in the soil thereby breaking the hydrocarbon bonds and releasing the hydrocarbons as a vapor. The volatized contaminant vapor separates from the soil and mixes with air inside a trommel housing 14, then is sucked out of the housing 14 by an air extraction machine 16 and into a bio-filter container 20 wherein the contaminant vapor is bioremediated. Treated soil is discharged out of the apparatus 10 by fine and coarse material conveyors 22, 24.

In the context of this description, the term "soil" includes sand, silt, clay, peats, organic material and blends thereof.

The term "contaminants" includes light end hydrocarbons, but can also refer to hydrocarbons of all phases in the C1-C40 range.

In this embodiment, parts are retrofitted onto an existing portable trommel machine to produce the soil remediation apparatus 10. However, it is within the scope of the invention to manufacture the soil remediation apparatus 10 in its entirety, i.e. without retrofitting an existing trommel machine. Trommel machines suitable for such retrofitting are well known, and include the line of trommel screeners manufactured by McCloskey International and Wildcat Manufacturing.

Figure 8:
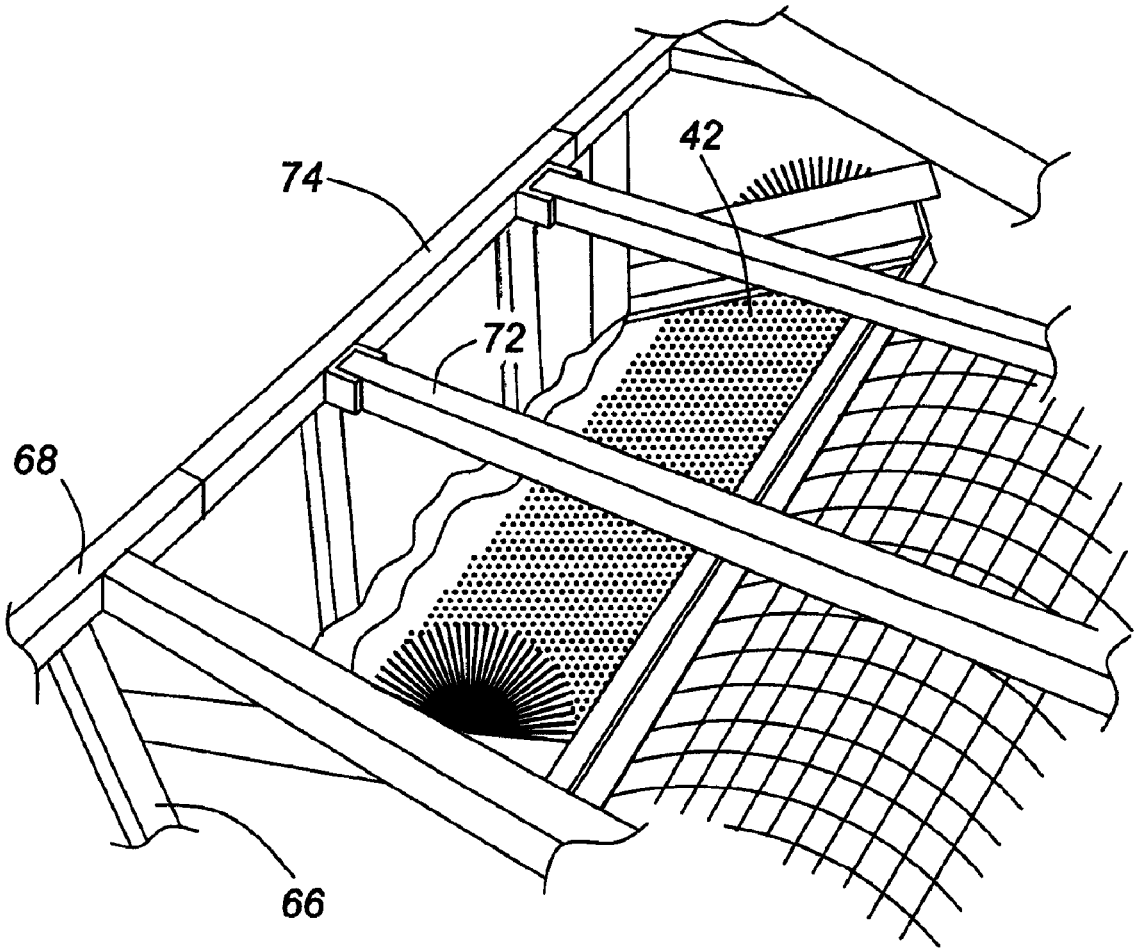
FIG. 8 is a detailed perspective view of part of the vapor cover frame.

As such trommel machines are well known in the art, they are not described in detail here. The exemplary trommel machine 30 shown in FIGS. 1 to 3 generally comprises a chassis 32, the rotary trommel screen 12, the trommel housing 14, the fine material conveyor 22, the coarse material conveyor 24, a feed hopper 36, and an engine 38. The chassis 32 is optionally provided with wheels 40 which enables the apparatus 10 to be easily transported. The trommel housing 14 is mounted on the chassis 32, and houses the trommel screen 12 therein. The housing 14 comprises a trough which supports the trommel screen 12 and comprises a plurality of panels and members which generally define a U-shaped trough in which the trommel screen 12 is mounted. The trommel screen 12 is mounted in the trough at an incline with its front (input) end inclined upwards. Cleaning brushes 42 (see FIG. 8) are mounted on the outside of the trommel screen 12 and operate to clean the trommel screen 12 when the trommel screen 12 rotates.

A supply conveyor (not shown) is located below the hopper 36 and operates to deliver untreated soil dropped from the hopper 36 into the inlet of the trommel screen 12. The engine 38 is rotatably coupled to the trommel screen 12 and operates to rotate the trommel screen 12. In a conventional trommel machine, the rotating trommel screen 12 will function to separate the soil into fine material which passes through the trommel screen 12, and coarse material which is discharged out of the rear (discharge) end thereof and onto the coarse material conveyor 24. An intermediate fine material conveyor (not shown) is located below the trommel screen 12 and operates to deliver the fine material to the fine material conveyor 22.

Figure 9:
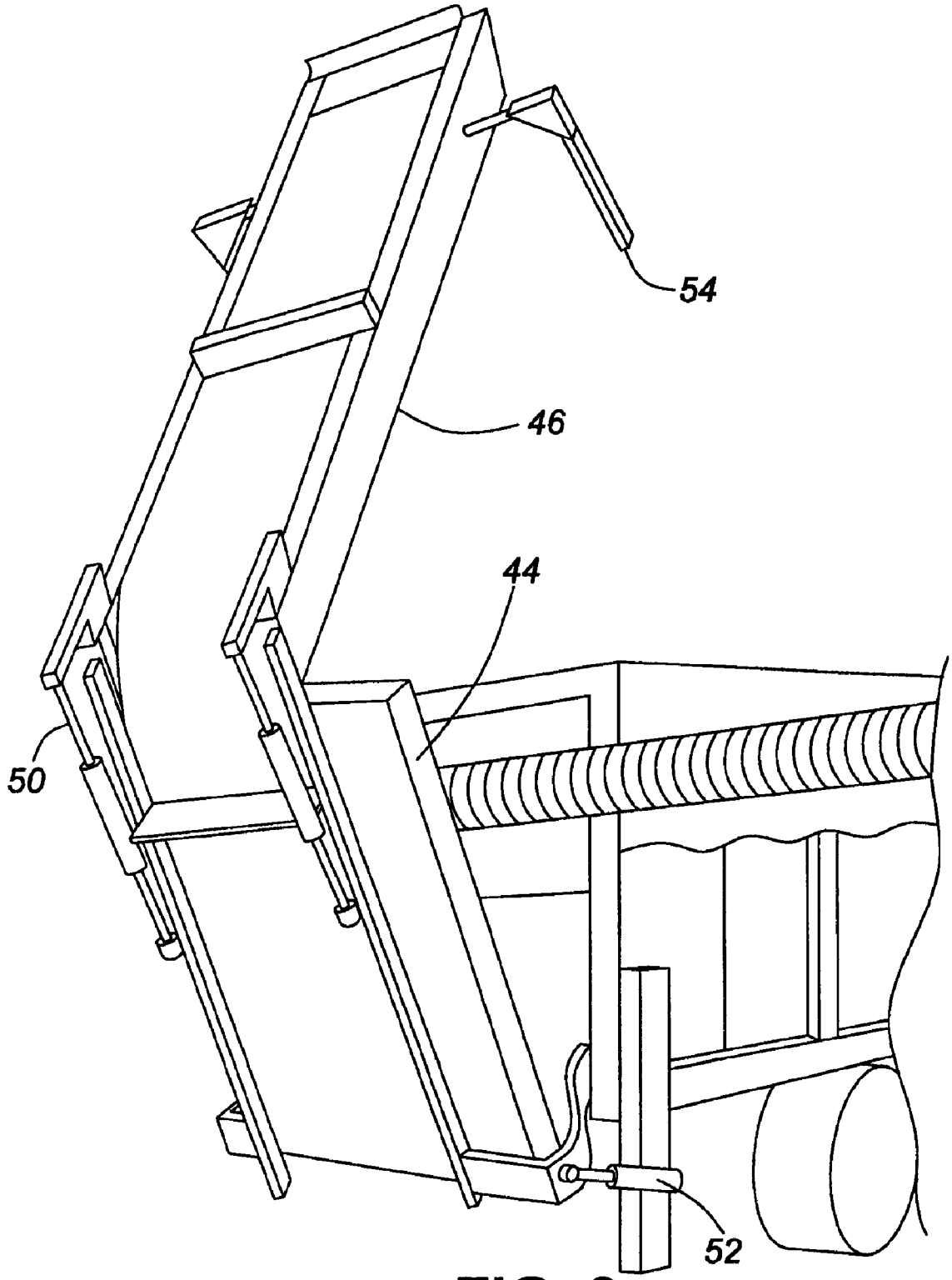
FIG. 9 is a perspective view of the conveyor and associated support struts in a partially deployed position.
Figure 10:
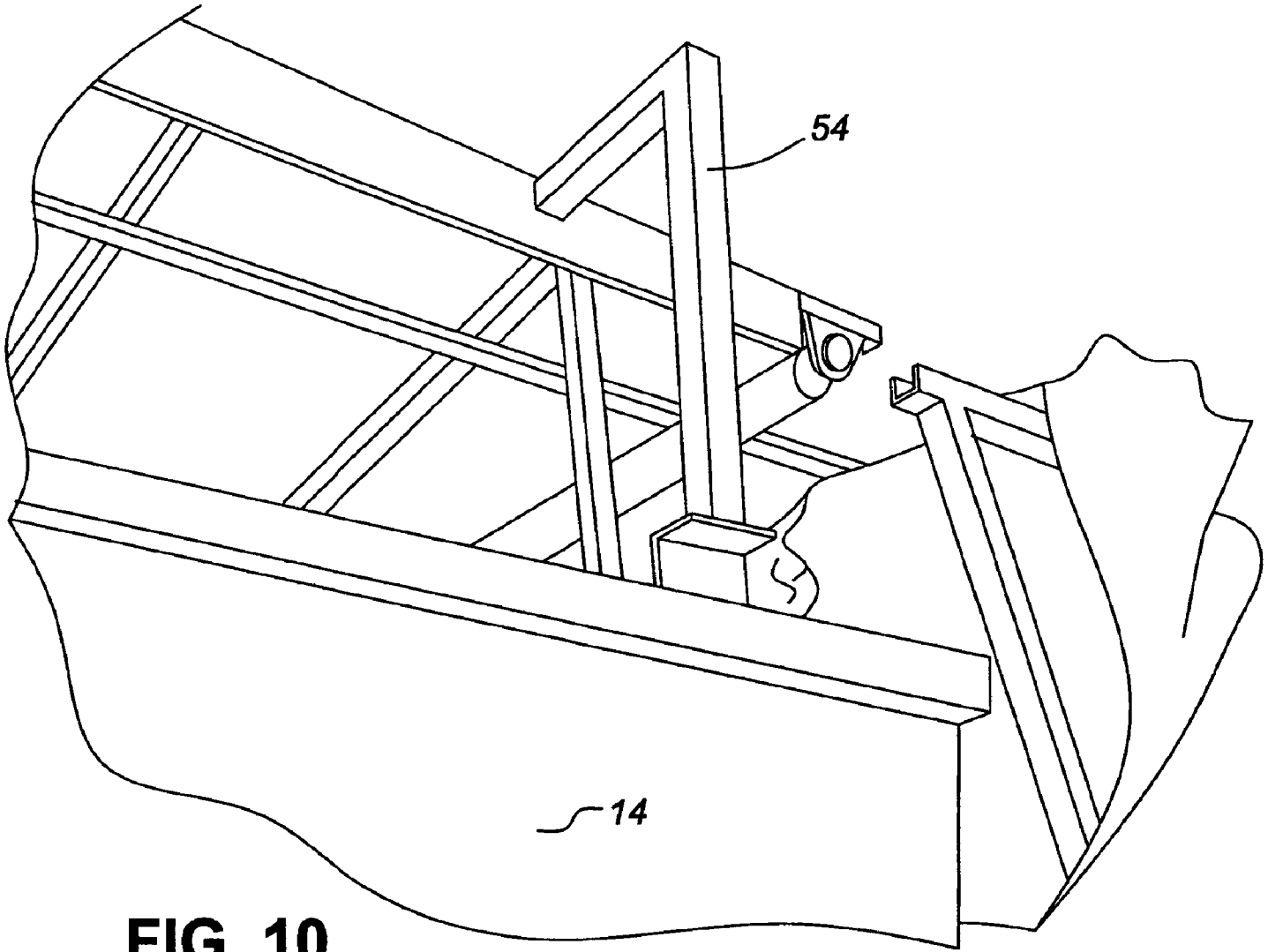
FIG. 10 is a perspective view of the conveyor and associated support struts in a stored position, wherein the support struts are resting on a sill in between the vapor cover frame.

The trommel machine 30 shown in FIGS. 1 to 3 is portable and thus has a coarse material conveyor 24 that can be folded into the machine 30 when the machine 30 is not in use or is being transported. This conveyor 24 comprises a lower part 44 and an upper part 46 pivotally connected together, with the lower part 44 pivotally connected to the chassis 32 adjacent the outlet end of the trommel screen 12. A pair of hydraulic pistons 50, 52 are provided for moving the conveyor 24 between deployed and retracted positions. Referring to FIG. 9, to retract the conveyor 24, pistons 52 fold the upper and lower parts 44, 46 into a vertical position, then pistons 50 fold the upper part 46 into a generally horizontal position over the trommel screen 12. Support struts 54 extending from the upper part 46 come to rest on the sill of the housing trough when the upper part 46 is folded into the stored horizontal position.

In a conventional trommel machine, agitation of the soil passing through the trammel screen 12 may cause any contaminants trapped in the soil to volatilize and escape into the atmosphere, as most of the trommel screen 12 is exposed to the environment. Therefore, means are provided in this embodiment to capture a substantial amount of the vapors for processing in the biofilter container 20. Referring now to FIGS. 5 to 8, the trommel housing 14 also includes a vapor cover frame 60 erected over the trommel screen 12, a rear cover plate 62 and curtain 64 mounted behind the trommel screen 12, and a front cover plate 61 mounted in front of the trommel screen 12. Referring to FIGS. 1 and 2, the housing 14 also includes a flexible vapor capture cover 66 which is secured over the frame 60. The cover 66 is made of a reinforced plastic sheet, but alternative materials with comparable flexibility and non-porosity can be substituted. The cover 66 and cover plates 61, 62 together with suction provided by the blower 16 serve to prevent most of the volatilized vapors from escaping into the atmosphere.

Figure 4:
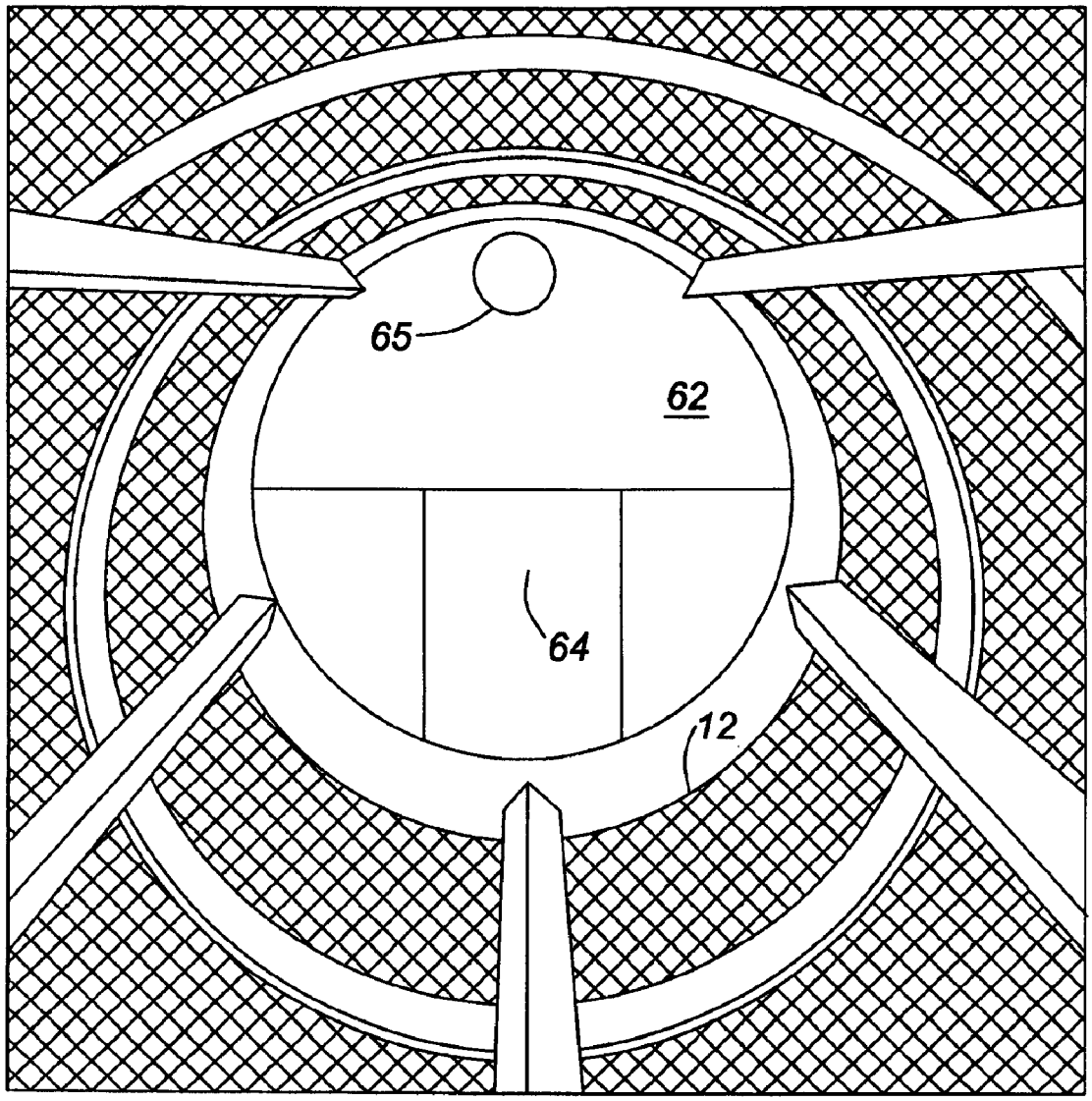
FIG. 4 is an end view of the inside of the trommel screen and a vapor discharge aperture of the soil remediation apparatus.
Figure 5:
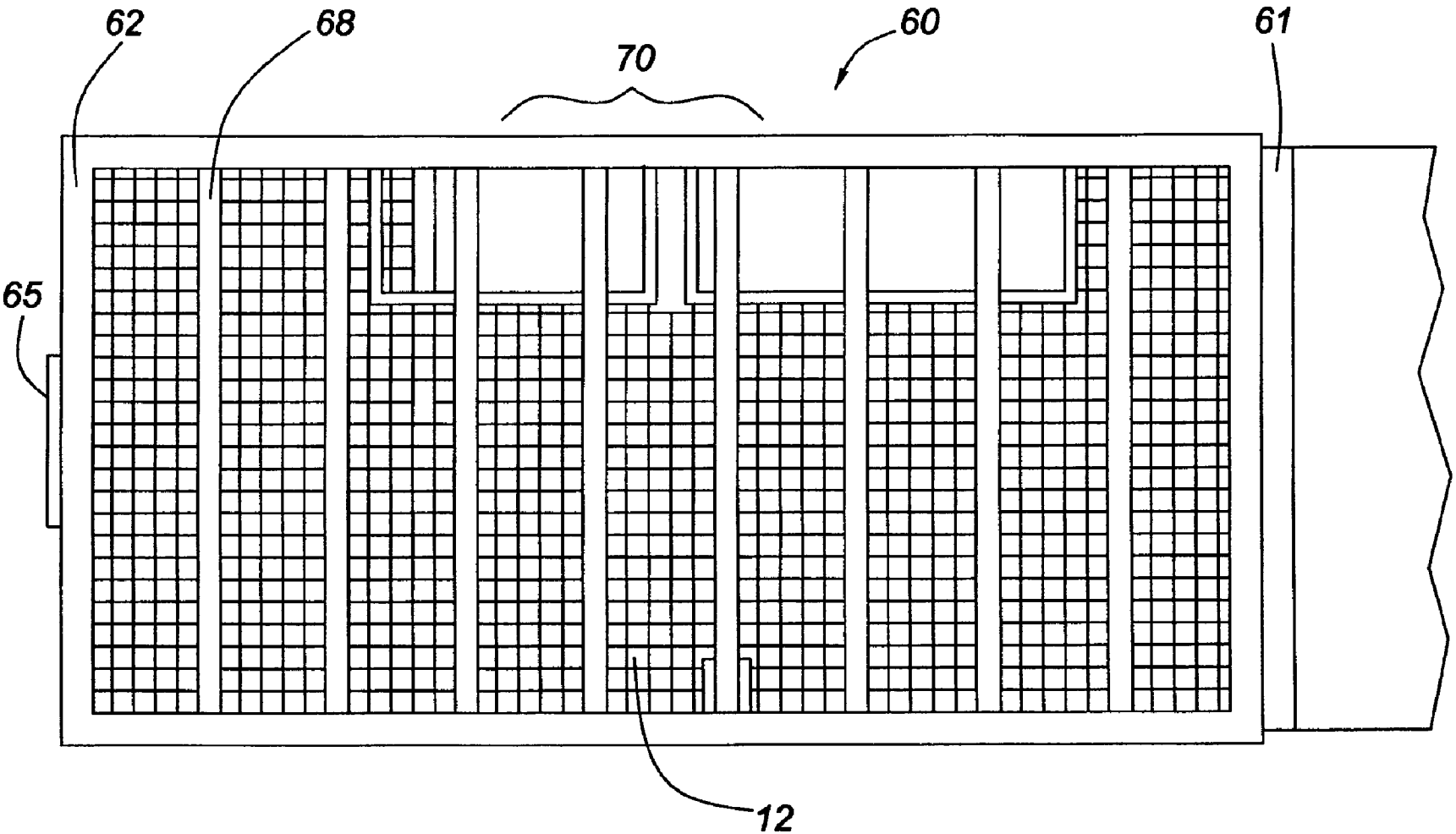
FIG. 5 is a top plan view of a part of the soil remediation apparatus, namely, a vapor cover frame, the trommel screen and cleaning brushes.
Figure 6:
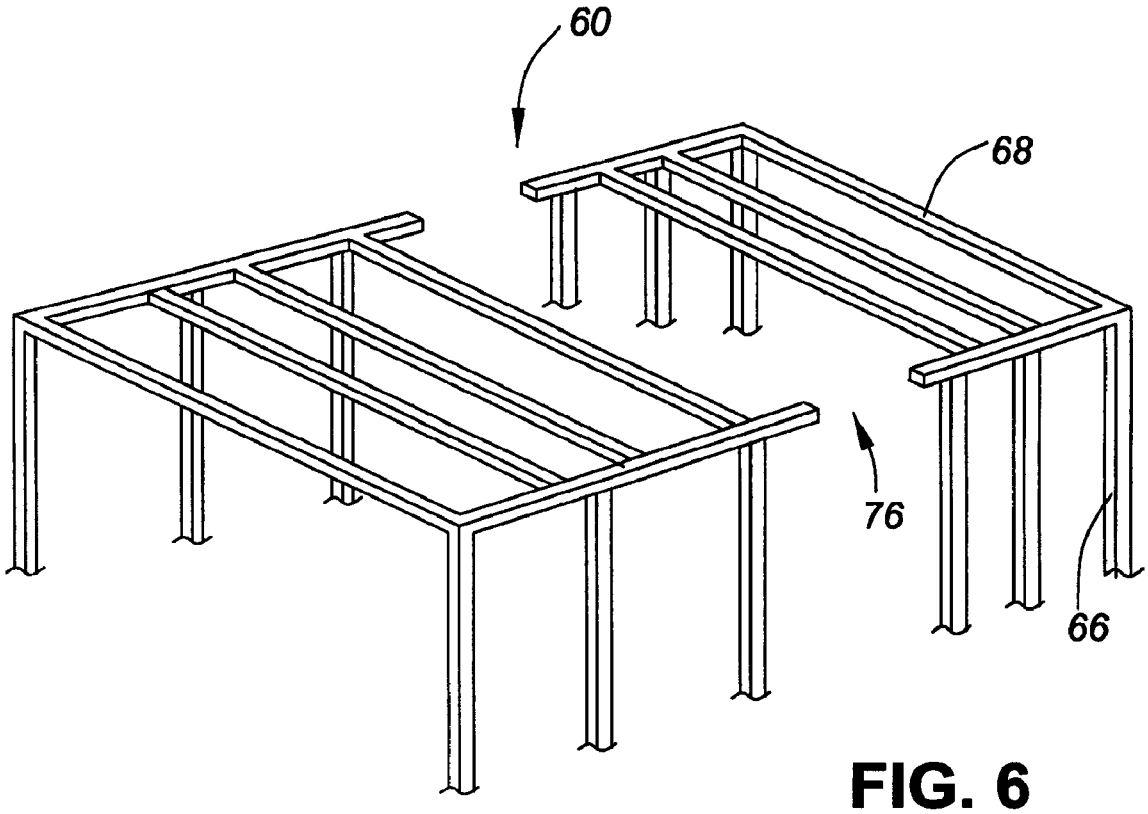
FIG. 6 is a perspective view of the vapor cover frame having a portion thereof removed to provide a space for receiving support struts from a stored conveyor.
Figure 7:
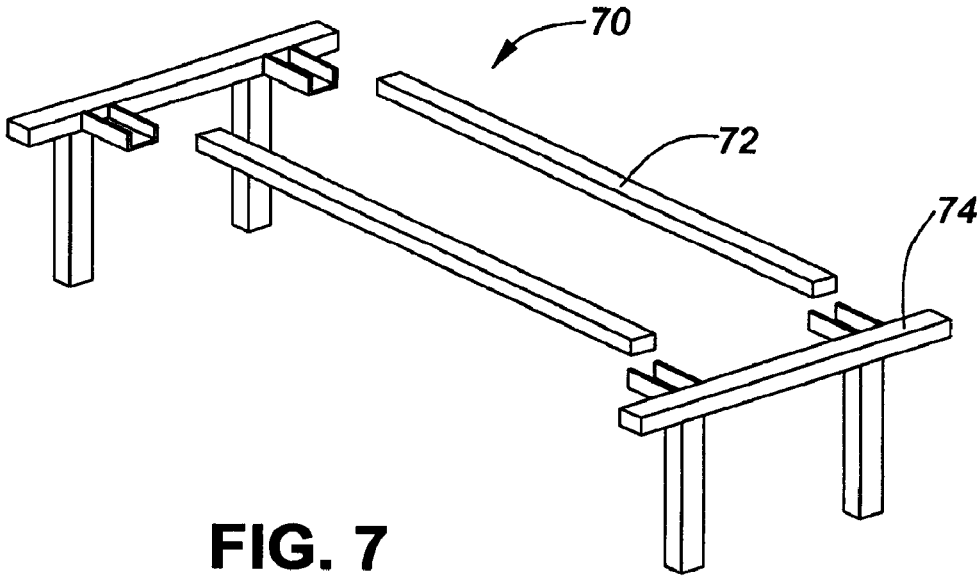
FIG. 7 is a perspective view of the portion of the vapor cover frame removed from the rest of the frame shown in FIG. 6.

Referring to FIGS. 3 and 4, the rear cover plate 62 is provided with a vapor discharge aperture 65 for coupling to a flexible discharge conduit 68 (shown in FIGS. 1 and 2). The curtain 64 is made of sections of flexible rubber fastened to the lower edge of the rear cover plate 62 and extends downwards to almost entirely cover the rear opening of trommel machine 30. A small gap is provided to allow the coarse treated soil to exit the trommel screen 12 and be deposited onto the coarse material conveyor 24. The curtain 64 is sufficiently flexible to allow larger material to also pass out of the trommel machine 30.

Referring again to FIGS. 5 to 8, the frame 60 comprises a plurality of steel members that provide a frame for supporting the cover 66 over the trommel screen 12. A plurality of vertical members 66 have a bottom end that are welded onto the trough sill. Transverse and longitudinal cross members 68 are welded to the top of the vertical members 66. The vertical and cross members 66, 68 are sized to form a frame 60 that provides enough clearance for the trommel screen 12 to operate as well as to accommodate the cleaning brushes 42. A removable frame section 70 comprises a pair of transverse cross bars 72 and right and left vertical sections 74; the removable frame section 70 fits within a gap 76 between the cross members 68. The gap 76 corresponds to the location where the support struts 54 from the coarse material conveyor 24 contact the trough sill. When the coarse material conveyor 24 is to be retracted, the removable frame section 70 is removed to allow the support struts 54 into the gap 76.

When the coarse material conveyor 24 is deployed and the apparatus 10 is to be operated to volatilize contaminants, the removable frame section 70 is installed in place and the cover 66 is wrapped tightly around the frame 60. The cover 66 is sufficiently large to extend over the sides of the frame 60 and below the top edge of the trough. Straps 90 are used to secure the cover 66 to the trough to provide a relatively closed space in which the trommel screen 12 resides. Use of the flexible cover 66 in combination with the frame 60 provides an easy means to access the trommel for servicing, repair etc.

The front cover plate serves to reduce the opening size between the trommel screen 12 and the hopper bulkhead at the intersection of these two components. The bulkhead is provided with a chute that prevents buildup of materials on the front ring of the trommel screen 12.

Properties of the trommel screen 12 such as diameter, length and mesh size are selected to enable the trommel screen 12 to sufficiently aerate the soil to volatilize the contaminants therein. It is evident to a person skilled in the art that different trommel screen properties will need to be selected based on the soil to be treated, and the amount of soil aeration required. The mesh size is selected to be sufficiently fine to prevent fine material from passing through the screen 12 before substantial volatilization has occurred, yet coarse enough to sufficiently aerate the soil and to prevent the soil from sticking onto the surface of the screen 12. It has been found that a mesh size of between ⅜" to 2", and preferably between ½" to 1 ½" will be suitable to treat most soils. The selected diameter and length of the trommel screen will depend on the desired processing capability of the apparatus 10.

While the primary purpose of the trommel screen 12 in this embodiment is to aerate the soil and volatilize vapors trapped therein, the trommel screen 12 can also be used to separate fine material from coarse material, in the conventional manner as well known in the art. In such case, fine and coarse material will be separated into two separate piles by the respective fine and coarse material conveyors. If separation is not required the piles can be combined.

The air extraction machine 16 comprises a motorized explosion proof blower as is known in the art. A suitable such blower is a 10 HP blower manufactured by Twin City Fan. As described above, the air extraction machine 16 is fluidly coupled to the outlet 65, and to the biofilter container 20 by the conduit 68. The blower is operated to provide a sufficient air exchange rate that substantially all of the volatilized contaminants captured in the housing 14 are extracted therefrom. For this embodiment, an air exchange rate of between 1800 cfm and 3000 cfm has been found to be suitable.

The biofilter container 20 contains biomass selected to bioremediate the volatilized contaminants that are fed into the container 20 by the extraction machine 16. The biomass includes a blend of silage, compost, wood chips and fertilizer material. A suitable biofilter container structure and biomass composition are commercially available, and thus are not described in detail here.

While the Figures show a single biofilter container 20, additional biofilter containers (not shown) can be provided depending on the bioremediation capacity required. When multiple biofilter containers are required, the conduit 68 downstream of the air extraction machine 16 can be branched to each of the biofilter containers.

Figure 11:
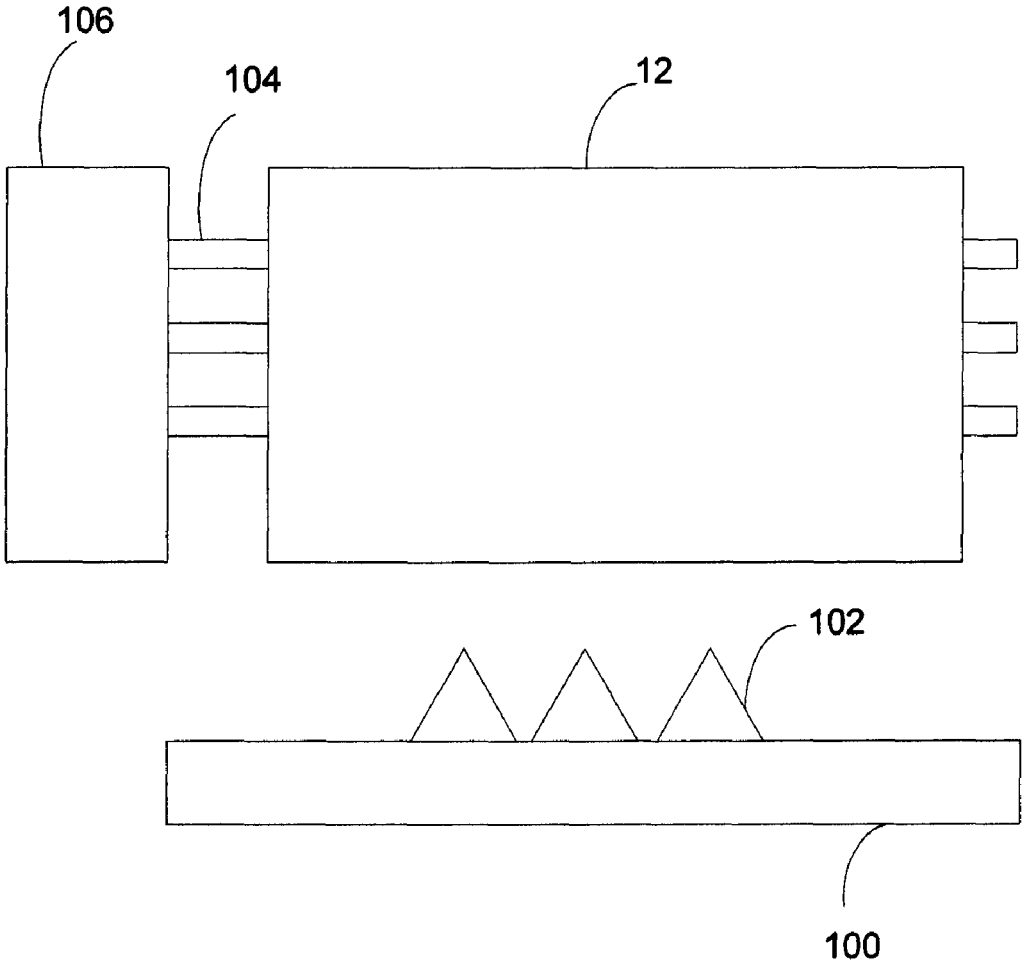
FIG. 11A is a block diagram of a heating system for the soil remediation apparatus.
FIG. 11B is a block diagram of another heating system for the soil remediation apparatus.
Figure 11A:
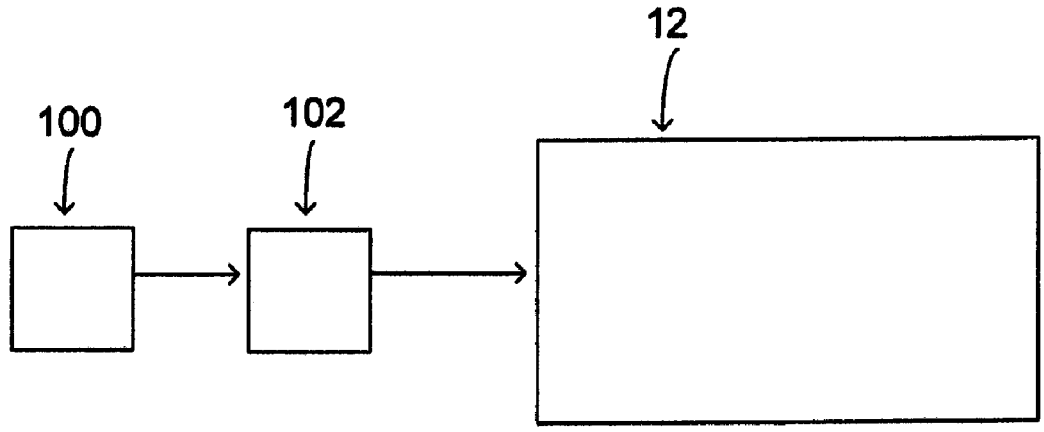
Figure 11B:
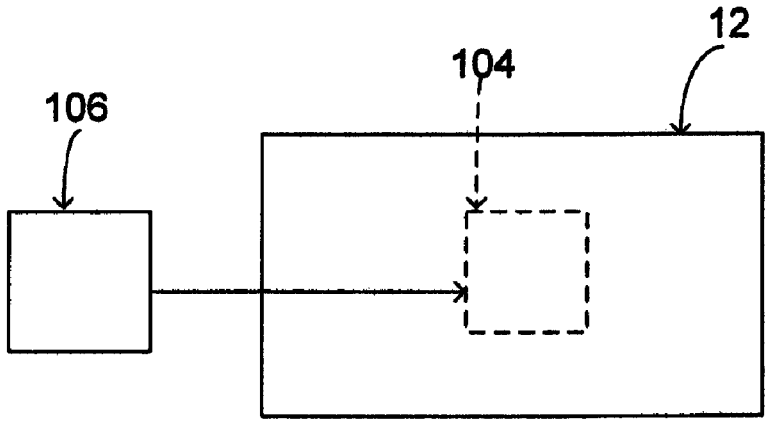

Optionally heated air can be blown into the trommel screen 12, as shown in FIG. 11A. Indirect fired heaters 100 can be provided to heat the air and air feed nozzles 102 can be mounted so as to direct the heated air into the screen. The heat from the heated air has been found to assist in the volatilization rate of the contaminants. Also optionally as shown in FIG. 11B, a plurality of hot water heating tubes 104 are mounted inside the trommel screen 12 and hot water heated from an external boiler 106 can be circulated therethrough to heat the air around the tubes 104. Such heated air can help in the volatilization rate of the soil.

In operation, the apparatus 10 is located near a site where contaminated soil is to treated. As the soil is treated ex-situ by the apparatus 10, a loader (not shown) is used to excavate the contaminated soil and deliver it to the apparatus 10. The loader drops the soil into the hopper 36, which is then directed into the inlet of the trommel screen 12 by the supply conveyor (not shown) located in the hopper bulkhead. The trommel screen 12 is rotated at a sufficient speed to aerate the soil and volatilize the contaminants trapped therein. Soil that is finer than the mesh size will fall through the trommel screen 12 and will be discharged from the apparatus 10 by the fine material conveyor 22. Coarser material will continue through the inside of the trommel screen 12 and be discharged onto the coarse material conveyor 24. The air extraction machine 20 is operated to extract air and volatilized contaminants from the housing 14 and into the biofilter container 20 for bioremediation. The discharged fine and coarse soil can be returned back into the apparatus 10 for further treatment if the single pass was insufficient to fully aerate the soil.

EXAMPLE

On a particular site with mostly coarse grained soils (aggregates) and some fine grained soils including clays, a 621 McCloskey Trommel equipped with ¾" screens and 1½" screens and modified into the soil remediation apparatus 10 as described above, has proven successful in achieving significant reductions in hydrocarbon content within the impacted soils. Moisture contents within the soils varied from 9% to 15% by weight and initial hydrocarbon concentrations varied from 266 ppm for C6-C10 hydrocarbons, 2810 ppm to 4180 ppm for C10-C16 hydrocarbons, and 1850 to 1240 ppm C16-C34 hydrocarbons. The apparatus 10 was successful in reducing the values to non detectable levels of C6-C10 hydrocarbons, 823 ppm to 418 ppm of C10-C16 hydrocarbons, and 458 ppm to 277 ppm of C16-C34 hydrocarbons in a single pass treatment.

While a particular embodiment of the present invention has been described in the foregoing, it is to be understood that other embodiments are possible within the scope of the invention and are intended to be included herein. It will be clear to any person skilled in the art that modifications of and adjustments to this invention, not shown, are possible without departing from the spirit of the invention as demonstrated through the exemplary embodiment. The invention is therefore to be considered limited solely by the scope of the appended claims.

The invention claimed is:

1. A soil remediation apparatus comprising:

(a) a trommel screen having an inlet and an outlet, the trommel screen having a surface that has a plurality of perforations;

(b) a trommel screen housing comprising:

a trough in which the trommel screen is mounted with its inlet inclined upwards;

a front cover mounted at the front of the trough, the front cover at least partially covering the trommel screen inlet and having an impacted soil inlet in communication with the trommel screen inlet;

a rear cover mounted at the rear of the trough, the rear cover at least partially covering the trommel screen outlet and having a vapor discharge outlet near the top of the trommel screen and a treated soil outlet in communication with the trommel screen outlet, a vapor cover frame at least partially removably mounted to the trough and a flexible vapor cover removably mounted over the frame and covering the trough, the flexible vapor cover being made of a flexible material such that it can be draped over the vapor cover frame and conform to the overall shape of the portion of the cover frame covered by the flexible vapor cover; and (c) air extraction means fluidly coupled to the vapor discharge outlet and operable to extract contaminant vapors volatilized by the trommel screen during soil aeration from the housing and to contaminant remediation means, wherein the front cover, rear cover, flexible vapor cover, and air extraction means together serve to prevent at least some volatilized vapors from escaping from the housing into atmosphere.

2. A soil remediation apparatus as claimed in claim 1 further comprising a coarse soil conveyor pivotally coupled to the housing near the rear cover, and pivotable between a deployed position and a retracted position.

3. A soil remediation apparatus as claimed in claim 2 wherein when the conveyor is in the retracted position, at least part of the conveyor is located above the vapor cover frame, and the frame comprises a removable section that when removed enables the frame to receive at least part of the retracted conveyor.

4. A soil remediation apparatus as claimed in claim 2 further comprising trommel cleaning brushes, and wherein the frame is configured to provide sufficient clearance for the housing to house the cleaning brushes therein.

5. A soil remediation apparatus as claimed in claim 1 wherein the rear cover further comprises a curtain covering at least a portion of the treated soil outlet.

6. A soil remediation apparatus as claimed in claim 1 further comprising a contaminant remediation means that is adapted to receive volatilized vapors extracted from the trommel screen.

7. A soil remediation apparatus as claimed in claim 6, wherein the contaminant remediation means comprises a biofilter.

8. A soil remediation apparatus as claimed in claim 1 further comprising at least one heated air feed nozzle directed to feed heated air into the trommel screen.

9. A soil remediation apparatus as claimed in claim 1 further comprising at least one hot water heating tube mounted inside the trommel screen and fluidly coupled to a hot water supply.

10. A soil remediation apparatus as claimed in claim 1 wherein the trommel screen has a screen size between ⅜" and 2".

11. A soil remediation apparatus as claimed in claim 1, wherein the vapor cover covers the trommel screen along its entire length and the trommel screen is rotatable relative to the vapor cover and the vapor cover frame.

12. A soil remediation apparatus as claimed in claim 1, wherein the vapor cover frame is configured to support the vapor cover such that when the vapor cover is wrapped over the vapor cover frame, the vapor cover covers the top of the trommel screen and at least partially covers the sides of the trommel screen.

13. A soil remediation apparatus as claimed in claim 1, wherein the vapor cover frame includes a plurality of upright frame members positioned on opposite sides of the trommel screen and extending the height of the trommel screen to support the vapor cover above the trommel screen.

14. A soil remediation apparatus as claimed in claim 13, wherein the vapor cover frame further includes a plurality of transverse frame members, each extending from an upper end of a respective upright frame member on one side of the trommel screen to an upper end of another upright frame member on the opposite side of the trommel screen.

15. A soil remediation apparatus as claimed in claim 1, wherein the vapor cover comprises a plurality of straps to secure the cover in place over the vapor cover frame.

16. A kit for modifying a trommel machine into a soil remediation apparatus comprising:

(a) a front cover having an impacted soil inlet and mountable to the front of a trommel screen trough of the trommel machine such that the impacted soil inlet is in communication with an inlet of a trommel screen of the trommel machine and the front cover at least partially covers the trommel screen inlet, the trommel screen having a surface with a plurality of perforations;

(b) a rear cover having a treated soil outlet and a vapor discharge outlet above the treated soil outlet and mountable to the rear of the trough such that the treated soil outlet is in communication with an outlet of the trommel screen and the vapor discharge outlet is near the top of the trommel screen, and such that the rear cover at least partially covers the trommel screen outlet;

(c) a vapor cover frame at least partially removably mountable to the trough;

(d) a flexible vapor cover removably mountable over the frame to cover the trough, the flexible vapor cover being made of a flexible material such that it can be draped over the vapor cover frame and conform to the overall shape of the portion of the cover frame covered by the flexible vapor cover; and (e) air extraction means for fluidly coupling to the vapor discharge outlet and operable to extract contaminant vapors volatilized by the trommel screen during soil aeration from the trommel machine and to contaminant remediation means, wherein the front cover, rear cover, flexible vapor cover, and air extraction means together serve to prevent at least some volatilized vapors from escaping from the housing into atmosphere.

17. A kit as claimed in claim 16 wherein the rear cover further comprises a curtain covering at least a portion of the treated soil outlet.

18. A kit further as claimed in claim 17 further comprising a contaminant remediation means.

19. A kit as claimed in claim 18 wherein the contaminant remediation means is a biofilter.

20. A kit as claimed in claim 16 further comprising at least one heated air feed nozzle directed to feed heated air into the trommel screen.

21. A kit as claimed in claim 16 further comprising at least one hot water heating tube mounted inside the trommel screen and fluidly coupled to a hot water supply.

22. A kit as claimed in claim 16, wherein the vapor cover frame is configured to support the vapor cover such that when the vapor cover is wrapped over the vapor cover frame, the vapor cover covers the top of the trommel screen and at least partially covers the sides of the trommel screen.

23. A kit as claimed in claim 16, wherein the vapor cover frame includes a plurality of upright frame members that are configured to be positioned on opposite sides of the trommel screen and to extend the height of the trommel screen such that the cover frame can support the vapor cover above the trommel screen.

* * * * *